US005785816A

United States Patent [19]

Schaible

[11] Patent Number: 5,785,816

[45] Date of Patent: Jul. 28, 1998

[54] METHOD FOR THE DEWATERING OF A PAPER FIBER MATERIAL LAYER IN A DOUBLE-SCREEN FORMER AND APPARATUS FOR ITS EXECUTION

[75] Inventor: Thomas Schaible, Castle Hill, Australia

[73] Assignee: Voith Sulzer Papiermaschinen GmbH, Heidenheim, Germany

[21] Appl. No.: 569,779

[22] Filed: Dec. 8, 1995

[30] Foreign Application Priority Data

Dec. 9, 1994 [DE] Germany ..... 44 43 874.5

[51] Int. Cl.[6] ..... D21F 1/00

[52] U.S. Cl. ..... 162/203; 162/300; 162/301

[58] Field of Search ..... 162/203, 300, 162/301, 348

[56] References Cited

U.S. PATENT DOCUMENTS

| | | | |
|---|---|---|---|
| 4,209,360 | 6/1980 | Stenberg et al. | 162/203 |
| 4,414,061 | 11/1983 | Trufih et al. | 162/301 |
| 4,925,531 | 5/1990 | Koski | 162/301 |
| 5,215,628 | 6/1993 | Koivuranta et al. | 162/301 |
| 5,282,933 | 2/1994 | Bubik et al. | 162/301 |
| 5,480,520 | 1/1996 | Esslinger | 162/301 |

FOREIGN PATENT DOCUMENTS

| | | | |
|---|---|---|---|
| 3524613 | 12/1986 | Germany | 162/348 |

OTHER PUBLICATIONS

Harwood "A Comparison of Top Wire Formers" P+P Canada, Jun. 1987 pp. 123–129.

*Primary Examiner*—Karen M. Hastings
*Attorney, Agent, or Firm*—Townsend and Townsend and Crew LLP

[57] ABSTRACT

Proposed is a method for the dewatering of a material layer (S) of paper fibers in a double-screen former, where the sheet weight (oven dried sheet weight (otro)) is more than 100 g/m$^2$ and/or the screen circulates with a speed of at least 100 m/min. In accordance with the invention the two screens are guided at two guide surfaces (5 and 7) which, for example, belong to open forming cylinders. In this arrangement forming cylinders of this kind are so dimensioned and positioned that no dewatering elements which contact one of the screens are present between the run-out line (11) of the screens (2, 3) from the first guide surface and the run-in line (12) at the second guide surface.

26 Claims, 3 Drawing Sheets

Fig. 1
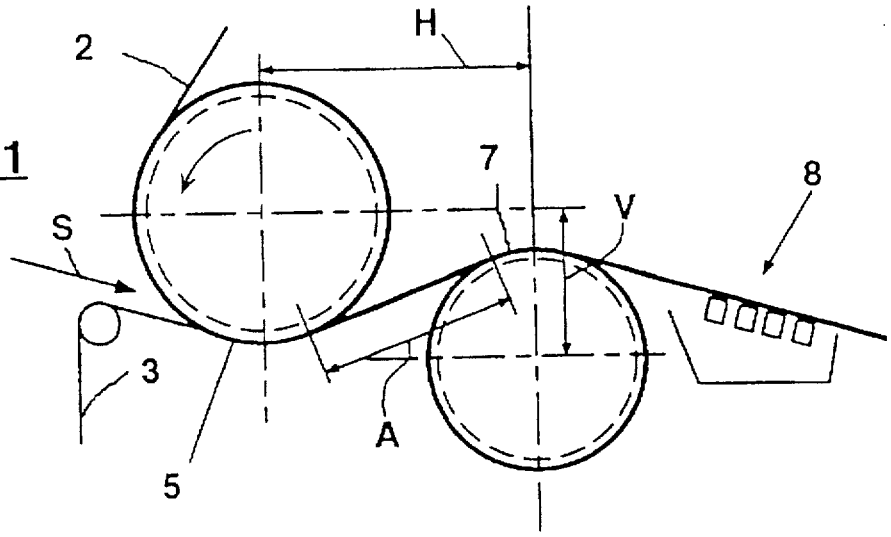
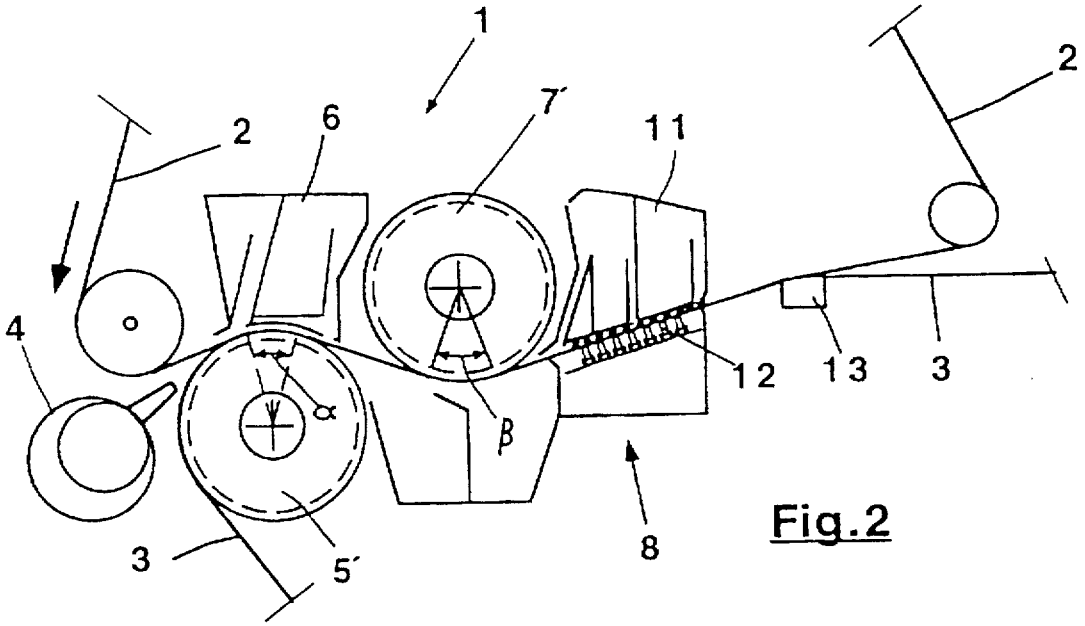
Fig.2

Fig. 3
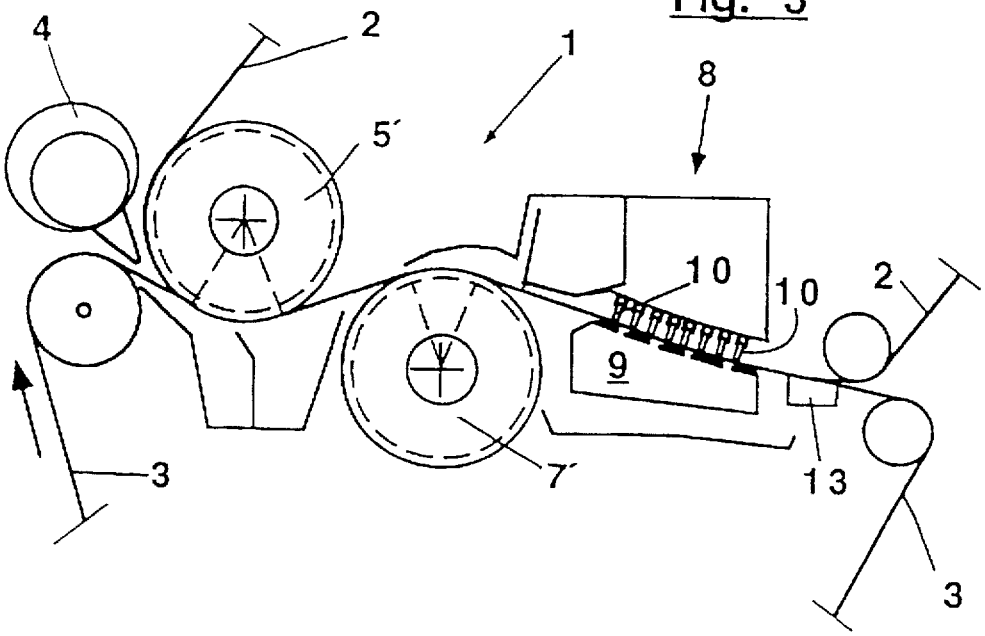
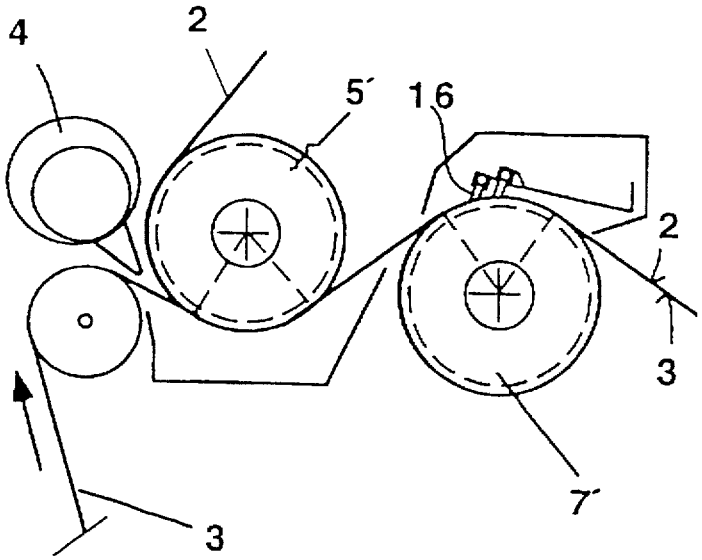
Fig. 4

METHOD FOR THE DEWATERING OF A PAPER FIBER MATERIAL LAYER IN A DOUBLE-SCREEN FORMER AND APPARATUS FOR ITS EXECUTION

FIELD OF THE INVENTION

The invention relates to a method of dewatering a material layer of paper fibers and to apparatus for carrying out this method.

More specifically the invention relates to a method of dewatering a material layer of paper fibers with a sheet weight of more than 100 g/m$^2$ (otro) and an initial solid material content between 0.8 and 3% in a double-screen former having two circulating endless screens that run together while forming a material inlet gap along a co-moving, circularly curved, permeable guide surface, wherein the two endless screens are at least partly jointly guided there, wherein, in the screen running direction, a second co-moving, circularly curved, permeable guide surface is present behind the first guide surface arranged in one of the screens and is arranged in the other screen, and wherein the second guide surface is followed by a further dewatering device with fixed elements, with the sheet formation being concluded at the further dewatering device.

In a further aspect the invention relates to a method of dewatering a material layer of paper fibers with an initial solid material content between 0.8 and 3% in a double-screen former having two circulating endless screens that run together while forming a material inlet gap along a co-moving, circularly curved, permeable guide surface, wherein the two endless screens are at least partly jointly guided there and circulate with a speed of at least 1000 m/min, wherein, in the screen running direction, a second co-moving, circularly curved, permeable guide surface is present behind the first guide surface arranged in one of the screens and is arranged in the other screen, and wherein the second guide surface is followed by a further dewatering device with fixed elements, with the sheet formation being concluded at the further dewatering device.

TECHNICAL BACKGROUND AND PRIOR ART

Paper fiber webs having a sheet weight of more than 100 g/m$^2$ (otro) are required for the production of comparatively heavy paper types or card types. The necessary rapid dewatering and formation of such layers in the gap formers of modern paper-making machines, in particular, fast-running paper-making machines, give rise to quite specific problems, in just the same way as with lighter types, when the machine operates at over 1000 m/min. It is admittedly known, for example from U.S. Pat. No. 4,925,531, to use a suction roll and a forming roll in sequence behind one another. This known arrangement however has a non-uniform dewatering action in the initial region that is particularly important. With correspondingly heavy types of paper and high speeds of operation of the paper-making machine, the dewatering length required on the forming roll furthermore becomes increasingly large, so that the technical realization is difficult.

OBJECTS OF THE INVENTION

It is the object of the invention to provide a dewatering method of the named kind which can also be used at high paper-making speeds, which thereby delivers a good formation, which can be executed in a space-saving manner, and which is not too complicated as a whole.

BRIEF DESCRIPTION OF THE INVENTION

This object is satisfied in a method of the initially named kind in that no stationary dewatering element that contacts one of the screens is present between the run-out line of the screens from the first guide surface and the run-in line at the second guide surface.

In the method of the invention, the action of two co-running, curved guide surfaces that directly follow one another, which are in particular realized as forming cylinders, is combined with the action of a dewatering device that follows them. In this arrangement the forming cylinders, which follow one another closely, act in a particularly caring manner on the relatively thick material layer and indeed alternatingly in respective oppositely disposed dewatering directions. Because both guide surfaces are not in the same endless screen, i.e. not located within the same endless screen, the direction of curvature of the screens changes on passage through the former. Because the water content of the layer is still high here, it need not however be feared that the layer can already be damaged by deflection of the web. The fiber material layer namely still has freely movable paper material fibers between the two forming cylinders since the sheet formation has not yet been concluded here. It has turned out that it is often favorable when the dry content (as a percentage) has an order of magnitude at the run-in to the second guide surface that corresponds to the numerical value of the sum of the diameters of the forming cylinders (in meters). Thus an effective uniform dewatering is effected to both sides with simultaneously good formation. With a short length of the two screens between the two forming cylinders, the suction effect of the preceding forming cylinder can favor the intake of the fiber material layer into the region of the second forming cylinder. In this way the formation is also caringly effected.

The dewatering action and the forming action of the guide surfaces, in particular on the forming cylinders, relate in known manner to the fact that the surface or the cylinder either contains recesses in which the water can collect until the screen is led away from the cylinder, or the cylinder surface is permeable and a depression (suction) is applied in the region where the screen wraps around the cylinder surface. In the first-named case the total water must be caught in suitable troughs or the like. The forming cylinders and collecting troughs thus cooperate. In the second case it can be advantageous to operate the first forming cylinder with suction and the second forming cylinder without suction. Other combinations are however also conceivable since the scope of application of the cases considered here is very broad.

The web weight is quoted here, as is customary, as the mass of the solid material content per unit of surface. Since the—water-free—quantity of solid material is determined after drying in a suitable oven, this statement is sometimes qualified by the addition "otro", meaning "oven dried".

The conclusion of sheet formation discussed in the description of the method is to be understood as follows: so long as the fibers can move freely, the sheet formation has not yet been concluded because the orientation and position of the fibers relative to one another can still change. With the longitudinal screen this limit is the so-called water line. Thereafter, only dewatering substantially takes place, and the formation is complete.

In accordance with one aspect of the present invention, the length of the section that is run through by the two screens and lies between the run-out line of the screens from the first guide surface and the run-in line at the second surface is not greater than 1000 mm.

In accordance with another aspect of the present invention, the length between the two guide surfaces is not greater than 150 mm.

In accordance with yet another aspect of the present invention, the material layer of paper fibers to be dewatered has a sheet weight between 200 and 500 g/m$^2$ (otro).

In accordance with a further aspect of the present invention, at least 90% of the dewatering necessary up to the conclusion of the sheet formation takes place at the guide surfaces and at the dewatering means that follows the latter when taken together.

In accordance with another aspect of the present invention, the first guide surface is contacted by both screens over an angle of wrap between 20 and 110 degrees.

In accordance with another aspect of the present invention, the second guide surface is contacted by both screens over an angle of wrap between 20 and 100 degrees.

In accordance with yet another aspect of the present invention, the dry content of the fiber material on running onto the second guide surface has a value in percent otro that corresponds to the numerical value of the sum of the diameters of both curved guide surfaces in meters.

In accordance with yet another aspect of the present invention, apparatus for dewatering a material layer of paper fibers includes a double-screened former serving for the manufacture of paper and having two circulating endless screens that run together along a forming cylinder while forming a material inlet gap, with both endless screens being guided at least partially over the circumference of the forming cylinder. One of the screens is a transport screen and the other is a counter-screen wherein in the direction of screen movement there is provided, behind the first forming cylinder arranged in one of the screens, a second forming cylinder arranged in the other screen. A further stationary dewatering device follows the second forming cylinder, and the length of the section run through by both screens that lies between the run-out line of the screens from the first guide surface and the run-in line at the second guide surface is not greater than 1000 mm. Over this length, no stationary dewatering elements that contact the screen are present.

BRIEF DESCRIPTION OF THE DRAWINGS

The invention will be illustrated and explained with reference to drawings. These show:

FIG. 1 is a schematic side view of an arrangement for carrying out the method;

FIGS. 2–5 are schematic side view of various double-screen formers that are suitable for carrying out the method and;

DESCRIPTION OF PREFERRED EMBODIMENTS

Figure 5:
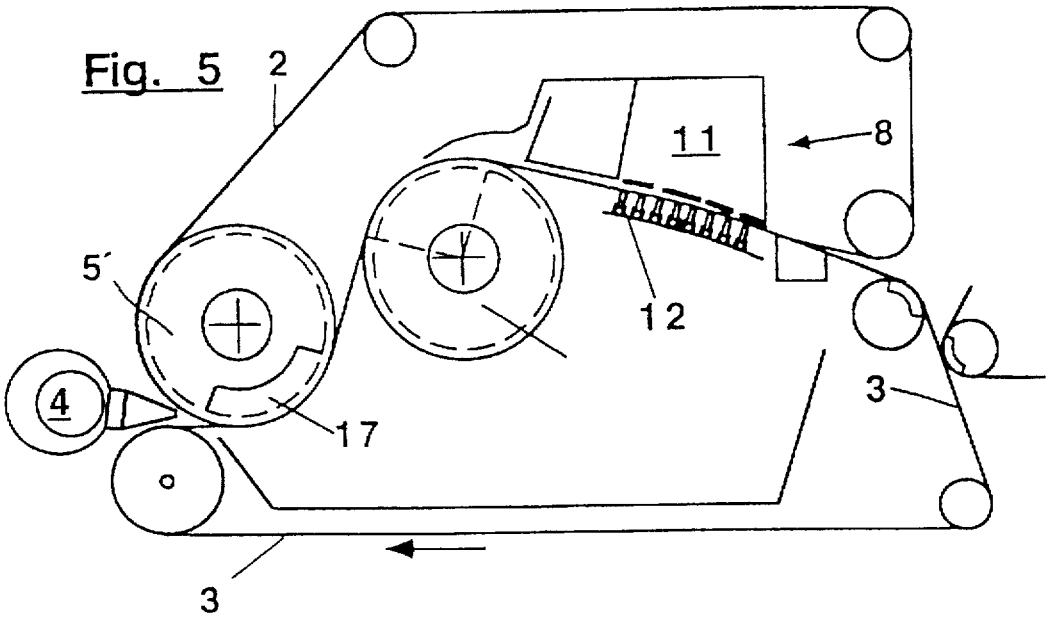

In the execution of the method in accordance with FIG. 1 a suspension S is injected or sprayed between two endless screens; namely, between a transport screen 3 and a counter screen 2 that run together. In this arrangement the screens are led together on a co-rotating, circularly curved guide surface 5. The guide surface 5 belongs to a screen cylinder that has openings at its cylinder jacket that can pick up the water, i.e. to an open forming cylinder. The two screens and the paper fiber material layer located therebetween are guided away from the first guide surface 5 onto the next guide surface 7, which belongs to a further forming cylinder. This forming cylinder also has openings at its jacket for picking up water. After both screens have been led away together with the paper fiber material layer the latter reaches a further dewatering device 8. Since this device has fixed elements, the screens move relative to it.

Important for carrying out the method is the manner in which the circularly curved guide surfaces 5 and 7 are arranged relative to one another. The said guide surfaces follow one another directly. In between there is the length A. For further definition of this arrangement, both the horizontal spacing H of the rotational axes or the two guide surfaces and also their vertical spacing V have been drawn in.

The horizontal spacing H of the axes of rotation of the two guide surfaces is preferably smaller than the sum of their diameters. The vertical spacing V of the axes of rotation is preferably smaller than the sum of the radii of the two guide surfaces.

At the dewatering device 8 that follows the guide surfaces, the web is subsequently dewatered to such a degree that the formation is terminated.

FIG. 2 schematically shows the most important parts of a double-screen former in accordance with the invention. The suspension passes out of the breast box 4 between the transport screen 3 and the counter-screen 2 and is dewatered on a first forming cylinder 5'. During this, the two screens wrap around this forming cylinder 5', with an angle alpha. The water thrown off in the region of the first forming cylinder 5' enters into a water box 6 that can be subjected to a depression (suction). The double-screen run is subsequently led over the forming cylinder 7', which it surrounds over an angle beta. Thereafter follows the dewatering device 8, in this case with adjustable pressure strips 12 and a suction box 11 lying in the counter screen. The two screens 2 and 3 are separated from one another in the subsequent separating device 13, with the material layer of paper fibers remaining on the transport screen 3.

The double-screen former shown in FIG. 3 is distinguished in some points from that of FIG. 2. The breast box 4 is somewhat differently arranged and generates a downwardly directed jet. Moreover, the first forming cylinder lies in the counter-screen 2. Through this arrangement, a greater angle of wrap is possible at the forming cylinder 5' on deflection of the double-screen into the horizontal direction. The dewatering device 8 lying behind the forming cylinder 7 is also somewhat differently constructed. It contains in the counter-screen 2 the adjustable pressure strips 10 and in the transport screen 3 a suction box 9. Further arrangements of such dewatering devices are naturally familiar to the person skilled in the art.

FIG. 4 shows further simplified a part of a double-screen former in which the angles of wrap of both forming cylinders 5' and 7' are greater than are shown in FIG. 3. Furthermore, adjustable pressure strips 16 are provided here at the second forming cylinder 7' that further increase the dewatering action.

FIG. 5 contains as a further variant an initial forming cylinder 5' with a suction means 17, wherein the water contained in the fiber material layer can be sucked off through the jacket of the forming cylinder 5'. In this case, the openings serve not only to pick up the water, but are rather also suitable to guide the water into the interior of the forming cylinder. In the case illustrated here, the subsequent forming cylinder 7' operates without suction. In the decision as to whether and in which of the forming cylinders suction should be selected, account must be taken of whether the water should be removed particularly quickly from the fiber material layer and which formation of the paper web is aimed at.

Figure 6:
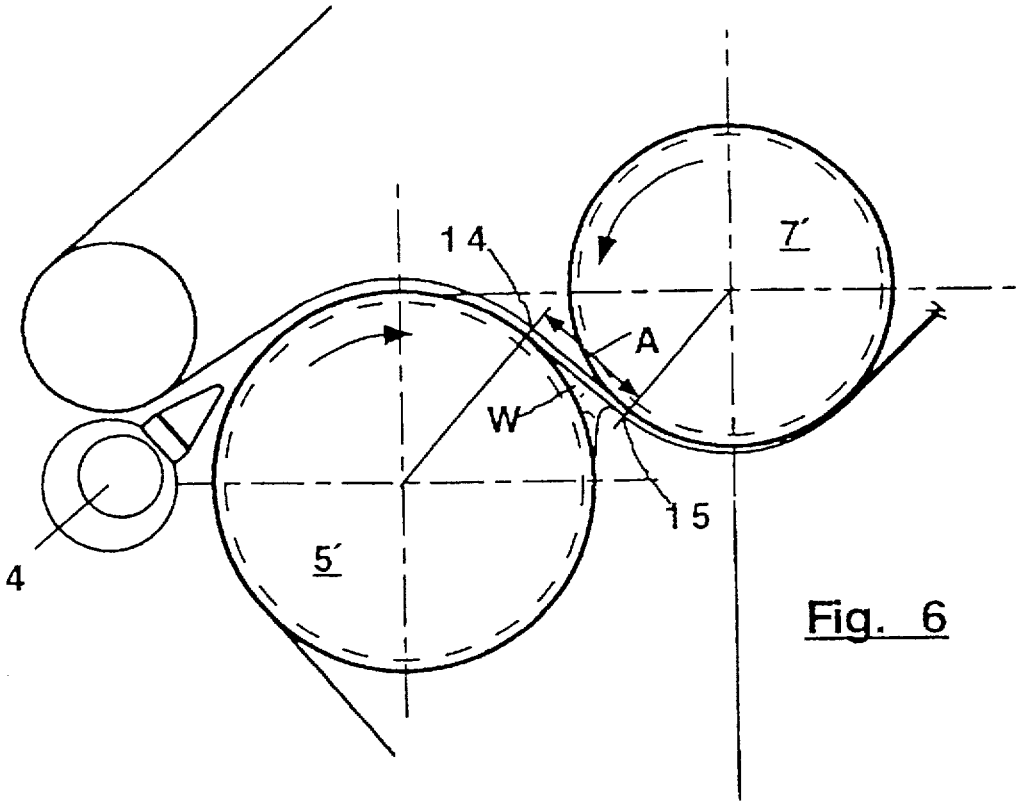
FIG. 6 is a schematic sketch to explain the processes that take place at the transition between two forming rolls.

FIG. 6 makes clear a special aspect of the forming cylinders 5' and 7', which stand relatively close alongside each other. On leading away the double-screen run from the first forming cylinder 5', a not inconsiderable depression arises that moves a water layer W along with it beneath the screen. This effect is illustrated in an exaggeratedly large manner for the sake of clarity. Between the run-out point 14 and the run-in point 15, after passing through the length A, the depression can be exploited to guide both screens with the relatively moist and instable fiber material layer lying between them at the forming cylinder screens in such a way that no damage arises. It is possible for a pressure to arise when both screens run onto the forming cylinder that is too great and that could lead to reverse flows in the layer. Such reverse flows would be extremely damaging and can be avoided in the process of the invention because the depression in the water layer W stabilizes the fiber material layer located between the two screens.

What is claimed:

1. A method of dewatering a material layer of paper fibers with a sheet weight of more than 100 g/m$^2$ (otro) and an initial solid material content between 0.8 and 3% in a double-screen former having two circulating endless screens that run together while forming a material inlet gap along a co-moving, circularly curved, permeable guide surface, wherein the two endless screens are at least partly jointly guided there, wherein, in the screen running direction, a second co-moving, circularly curved, permeable guide surface is present behind and generally horizontally adjacent to the first guide surface arranged in one of the screens and is arranged in the other screen, and wherein the second guide surface is followed by a further dewatering device with fixed elements, with the sheet formation being concluded at the further dewatering device, wherein no stationary dewatering element that contacts one of the screens is present between a run-out line of the screens from the first guide surface and a run-in line at the second guide surface, a length of a section that is run through by the two screens and lies between the run-out line of the screens from the first guide surface and the run-in line at the second guide surface is not greater than 150 mm, and wherein the first guide surface is contacted by both screens over an angle of wrap between 20 and 110 degrees and the second guide surface is contacted by both screens over an angle of wrap between 20 and 110 degrees.

2. A method in accordance with claim 1, wherein the material layer of paper fibers to be dewatered has a sheet weight between 200 and 500 g/m$^2$ (otro).

3. A method in accordance with claim 1, wherein at least 90% of the dewatering necessary up to the conclusion of the sheet formation takes place at the guide surfaces and at the dewatering means that follows the latter when taken together.

4. A method in accordance with claim 1, wherein the first guide surface lies in (within) the transport screen and the second guide surface lies in (within) the counter-screen.

5. A method in accordance with claim 1, wherein the first guide surface lies in (within) the counter-screen and the second guide surface lies in (within) the transport screen.

6. A method in accordance with claim 1, wherein the dry content of the fiber material layer on running onto the second guide surface has a value in percent otro that corresponds to the numerical value of the sum of the diameters of both curved guide surfaces in meters.

7. A method in accordance with claim 1, wherein a depression acting on at least one region contacted by the screens is present at at least one of the guide surfaces.

8. A method in accordance with claim 1, wherein the horizontal spacing of the axes of rotation of the two guide surfaces from one another is smaller than the sum of their diameters and the vertical spacing of the axes of rotation is smaller than the sum of their radii.

9. A method of dewatering a material layer of paper fibers with an initial solid material content between 0.8 and 3% in a double-screen former having two circulating endless screens that run together while forming a material inlet gap along a co-moving, circularly curved, permeable guide surface, wherein the two endless screens are at least partly jointly guided there and circulate with a speed of at least 1000 m/min, wherein, in the screen running direction, a second co-moving, circularly curved, permeable guide surface is present behind and generally horizontally adjacent to the first guide surface arranged in one of the screens and is arranged in the other screen, and wherein the second guide surface is followed by a further dewatering device with fixed elements, with the sheet formation being concluded at the further dewatering device, wherein no stationary dewatering element that contacts one of the screens is located between a run-out line of the screens from the first guide surface and a run-in line at the second guide surface, a length of a section that is run through by the two screens and lies between the run-out line of the screens from the first guide surface and the run-in line at the second guide surface is not greater than 150 mm, and wherein the first guide surface is contacted by both screens over an angle of wrap between 20 and 110 degrees and the second guide surface is contacted by both screens over an angle of wrap between 20 and 110 degrees.

10. A method in accordance with claim 9, wherein the length of the section that is run through by the two screens and lies between the run-out line of the screens from the first guide surface and the run-in line at the second guide surface is not greater than 1000 mm.

11. A method in accordance with claim 10, wherein the length between the two guide surfaces is not greater than 150 mm.

12. A method in accordance with claim 9, wherein the material layer of paper fibers to be dewatered has a sheet weight between 200 and 500 g/m$^2$ (otro).

13. A method in accordance with claim 9, wherein at least 90% of the dewatering necessary up to the conclusion of the sheet formation takes place at the guide surfaces and at the dewatering means that follows the latter when taken together.

14. A method in accordance with claim 9, wherein the first guide surface lies in (within) the transport screen and the second guide surface lies in the counter-screen.

15. A method in accordance with claim 9, wherein the first guide surface lies in (within) the counter-screen and the second guide surface lies in (within) the transport screen.

16. A method in accordance with claim 9, wherein the dry content of the fiber material layer on running onto the second guide surface has a value in percent otro that corresponds to the numerical value of the sum of the diameters of both curved guide surfaces in meters.

17. A method in accordance with claim 9, wherein a depression acting on at least one region contacted by the screens is present at at least one of the guide surfaces.

18. A method in accordance with claim 9, wherein the horizontal spacing of the axes of rotation of the two guide surfaces from one another is smaller than the sum of their diameters and the vertical spacing of the axes of rotation is smaller than the sum of their radii.

19. Apparatus for dewatering a material layer of paper fibers, comprising a double-screen former serving for the manufacture of paper and having two circulating endless screens that run together along a forming cylinder while forming a material inlet gap, with both endless screens being guided at least partially over the circumference of the forming cylinder, wherein one of the screens is a transport screen and the other is a counter-screen, wherein, in the direction of screen movement, there is provided, behind and generally horizontally adjacent to the first forming cylinder arranged in one of the screens, a second forming cylinder arranged in the other screen, and wherein a further stationary dewatering device follows the second forming cylinder, wherein the length of the section run through by both screens that lies between a run-out line of the screens from the first guide surface and a run-in line at the second guide surface is not greater than 150 mm, wherein over this length no stationary dewatering elements that contact the screen are present, and wherein the first guide surface is contacted by both screens over an angle of wrap between 20 and 110 degrees and the second guide surface is contacted by both screens over an angle of wrap between 20 and 110 degrees.

20. Apparatus in accordance with claim 19, wherein the suspension that serves for the formation of the material layer of paper fibers emerges from a breast box and passes as a broad jet or flow into the region in which the screens are led together.

21. Apparatus in accordance with claim 19, wherein a device for receiving the water that passes through the counter-screen is provided above the first forming cylinder and can be subjected to suction to pick up the water.

22. Apparatus in accordance with claim 19, wherein the first forming cylinder has a plurality of recesses that are only open towards its outer surface.

23. Apparatus in accordance with claim 19, wherein the second forming cylinder has a plurality of recesses that are only open to its outer surface.

24. Apparatus in accordance with claim 19, wherein the first forming cylinder is a suction roll having a suction region that is active substantially at the part surrounded by the screen.

25. Apparatus in accordance with claim 19, wherein the second forming cylinder is a suction roll with a perforated jacket and a suction region that is active substantially at the part surrounded by the screen.

26. Apparatus in accordance with claim 19, wherein, in the active region of the second forming cylinder, pressure strips contact the screen opposite to the second forming cylinder with an adjustable contact pressure force.

* * * * *